US010113818B2

(12) United States Patent
Agee

(10) Patent No.: US 10,113,818 B2
(45) Date of Patent: Oct. 30, 2018

(54) BIMETALLIC FIN WITH THEMO-ADJUSTING TURBULATION FEATURE

(71) Applicant: HONEYWELL INTERNATIONAL INC., Morris Plains, NJ (US)

(72) Inventor: Keith Agee, Torrance, CA (US)

(73) Assignee: GARRETT TRANSPORTATION I INC., Torrance, CA (US)

( * ) Notice: Subject to any disclaimer, the term of this patent is extended or adjusted under 35 U.S.C. 154(b) by 346 days.

(21) Appl. No.: 15/008,353

(22) Filed: Jan. 27, 2016

(65) Prior Publication Data

US 2017/0211897 A1 Jul. 27, 2017

(51) Int. Cl.

| | |
|---|---|
| ***F28F 13/12*** | (2006.01) |
| ***F28F 3/02*** | (2006.01) |
| ***F01P 11/08*** | (2006.01) |
| ***F28D 9/00*** | (2006.01) |
| *F28D 21/00* | (2006.01) |

(52) U.S. Cl.

CPC ..... *F28F 13/12* (2013.01); *F01P 11/08* (2013.01); *F28D 9/00* (2013.01); *F28F 3/02* (2013.01); *F28F 3/027* (2013.01); *F01P 2060/04* (2013.01); *F28D 2021/0089* (2013.01); *F28F 2215/14* (2013.01); *F28F 2250/04* (2013.01); *F28F 2255/04* (2013.01)

(58) Field of Classification Search

CPC ..... F28F 3/00; F28F 3/02; F28F 3/04; F28F 3/042; F28F 3/044; F28F 9/24; F28F 13/00; F28F 13/06; F28F 13/12; F28F 2215/14; F28F 2255/04; F16N 39/00; F16N 39/02; F16N 39/04; F01P 11/08

USPC ..... 165/109.1, 200, 287; 236/93 R

See application file for complete search history.

(56) References Cited

U.S. PATENT DOCUMENTS

| | | | | |
|---|---|---|---|---|
| 4,337,737 | A | 7/1982 | Pechner | |
| 5,653,285 | A * | 8/1997 | Lee | F28F 3/02 165/185 |
| 6,128,188 | A * | 10/2000 | Hanners | H01L 23/34 361/694 |
| 6,263,955 | B1 * | 7/2001 | Azar | F28F 3/02 165/185 |
| 6,330,157 | B1 * | 12/2001 | Bezama | H01L 23/34 165/185 |
| 6,615,910 | B1 * | 9/2003 | Joshi | F28F 3/02 165/185 |

(Continued)

FOREIGN PATENT DOCUMENTS

| | | |
|---|---|---|
| EP | 2860401 A2 | 4/2015 |
| FR | 2930324 A1 | 10/2009 |

(Continued)

OTHER PUBLICATIONS

Search report from EP Application No. 16199709.3 dated May 30, 2017.

*Primary Examiner* — Keith Raymond
*Assistant Examiner* — Gustavo Hincapie Serna
(74) *Attorney, Agent, or Firm* — Shimokaji IP

(57) ABSTRACT

An oil cooler comprises a cooler core having an oil fin. The oil fin includes a moveable window. The moveable window includes a base and a first flap on one side of the base. The first flap moves between a closed position and an open position. The first flap is in the open position when the cooler core is in a hot condition.

7 Claims, 6 Drawing Sheets

(56) References Cited

U.S. PATENT DOCUMENTS

| | | | | |
|---|---|---|---|---|
| 7,778,029 | B2 * | 8/2010 | Ueno | G11B 33/142 361/695 |
| 9,818,672 | B2 * | 11/2017 | Skinner | H01L 23/467 |
| 2001/0029767 | A1 * | 10/2001 | Adams | B21D 13/02 72/326 |
| 2006/0048921 | A1 * | 3/2006 | Usui | F28D 7/1684 165/109.1 |
| 2006/0237078 | A1 * | 10/2006 | Luvisotto | F16K 15/16 137/855 |
| 2006/0237185 | A1 * | 10/2006 | Peric | G05D 23/10 165/297 |
| 2009/0200007 | A1 | 8/2009 | Foy et al. | |
| 2009/0314265 | A1 * | 12/2009 | Freese V | F02M 26/28 123/568.12 |
| 2015/0053390 | A1 * | 2/2015 | Banks | F04C 29/02 165/287 |
| 2015/0173241 | A1 * | 6/2015 | Hsu | H05K 7/20209 165/287 |
| 2017/0131047 | A1 * | 5/2017 | Ahbel | F28F 27/02 |

FOREIGN PATENT DOCUMENTS

| | | | |
|---|---|---|---|
| JP | 59120375 | U | 8/1984 |
| WO | 2017030089 | A1 | 2/2017 |

* cited by examiner

BIMETALLIC FIN WITH THEMO-ADJUSTING TURBULATION FEATURE

BACKGROUND OF THE INVENTION

The present invention generally relates to oil coolers and, more particularly, apparatus and methods for increasing heat transfer when the oil cooler is hot.

Oil cooler fins can be of a turbulating type to provide maximum heat transfer when hot. However, when cold, the oil does not require cooling and the high viscosity creates high pressure drop when flowing through a highly turbulated fin surface.

To mitigate this problem, oil coolers often have a bypass line at low oil temperatures. This adds cost and complexity to the system, since an actuator and a control are needed.

As can be seen, there is a need for improved apparatus and methods for increased heat transfer in oil coolers having turbulated fins.

SUMMARY OF THE INVENTION

In one aspect of the present invention, an oil cooler comprises a cooler core having an oil fin; wherein the oil fin includes a moveable window; wherein the moveable window includes a base and a first flap on one side of the base; wherein the first flap moves between a closed position and an open position; wherein the first flap is in the open position when the cooler core is in a hot condition.

In another aspect of the present invention, an oil cooler comprises a cooler core having a first oil fin element and a second oil fin element; wherein the first and second oil fin elements provide: a first oil path within the first oil fin element; a second oil path within the second oil fin element; a third oil path between the first and second oil fin elements; wherein the first oil fin element includes a first window flap that moves between a first closed position and a first open position; wherein the second oil fin element includes a second window flap that can move between a second closed position and a second open position; wherein, when the first window flap is in the first open position, the first window flap extends into the third oil path; wherein, when the second window flap is in the second open position, the second window flap extends into the third oil path.

In a further aspect of the present invention, an oil cooler comprises a cooler core having a cooling passageway and an oil passageway; wherein the oil passageway includes a serpentine-shaped fin; wherein the fin creates an oil flow path; wherein the fin has one side with a first coefficient of thermal expansion (COE) and a second side with a second coefficient of thermal expansion; wherein the first COE is greater than the second COE; wherein the fin has a first moveable window on one side of the oil flow path; and wherein the first moveable window moves into the oil flow path when the cooler core is in a hot condition.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, this invention provides an oil cooler with fins made of a bimetallic material. One side of the fin material has a high thermal expansion and the other side has a substantially lower thermal expansion. When heated and allowed to expand, the material will bend into a curve since the high expansion material will increase in length. The remaining part of the fin can be a typical brazed design such as a bar plate or a stamped plate. Window flaps are cut out on three sides of a leg of the fin.

In a cold state, the fins are straight, allowing free flow of cold oil with a minimum pressure drop. As the oil temperature increases, the window flap starts to curve into the flow stream, increasing the turbulence and the heat transfer. The hotter the oil, the greater the increased bending and resulting turbulence.

Figure 1:
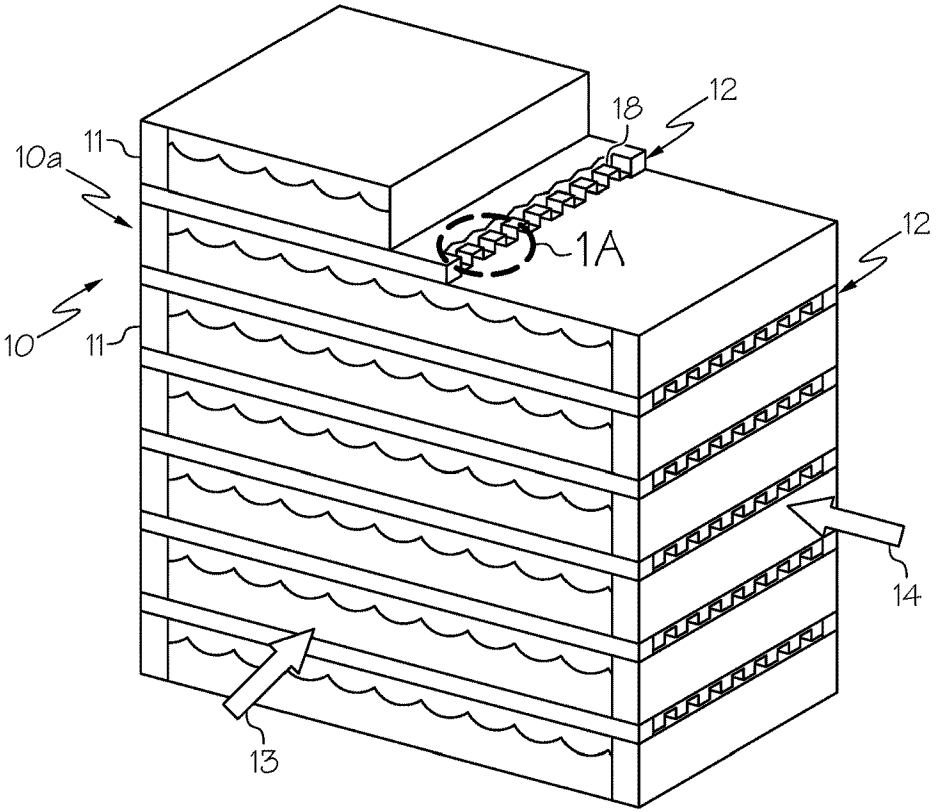
FIG. 1 is a perspective, partial cut-away view of a core of an oil cooler according to an embodiment of the present invention.

FIG. 1 depicts an exemplary oil cooler 10 that can be, for example, an air oil cooler as known in the art. The oil cooler 10 can have an oil cooler core 10*a* that has a cooling fluid passageway 11 in cross flow communication with an oil passageway 12. The cooling fluid passageway 11 may receive a cooling fluid flow 13, while the oil passageway 12 may receive an oil flow 14. The cooler 10 may have other commonly provided components well known in the art, such as plenums, inlet/outlet, and bypass valve.

Figure 1A:
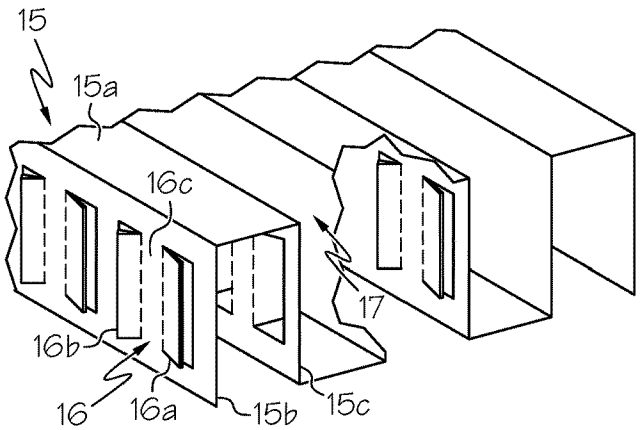
FIG. 1A is a detailed drawing of segment A of FIG. 1.

FIG. 1A shows that the oil passageway 12 may have a fin 18, such as a serpentine-shaped fin, that can extend across an entire width and/or length of the oil passageway 12. In an embodiment, the fin 18 can be made of a bi-material, wherein one side of the fin is made of a first material having a first coefficient of thermal expansion and a second and opposite side is made of a second material having a second coefficient of thermal expansion. In embodiments, the first coefficient of thermal expansion is greater than the second coefficient of thermal expansion.

In an embodiment, the difference between the first and second coefficients of thermal expansion can be from about $2\times10^{-6}$ $K^{-1}$ to about $20\times10^{-6}$ $K^{-1}$ Thus, as an example, the first material may be $1.5\times10^{-6}$ $K^{-1}$, and the second material may be $17.3\times10^{-6}K^{-1}$ In FIG. 1A, the fin 18 may include a one or more fin elements 15. One or more of the fin elements 15 may include a base 15*a*, a first leg 15*b* on one side of the base 15*a*, and a second leg 15*c* on another and opposite side of the base 51*a*.

Figure 2:
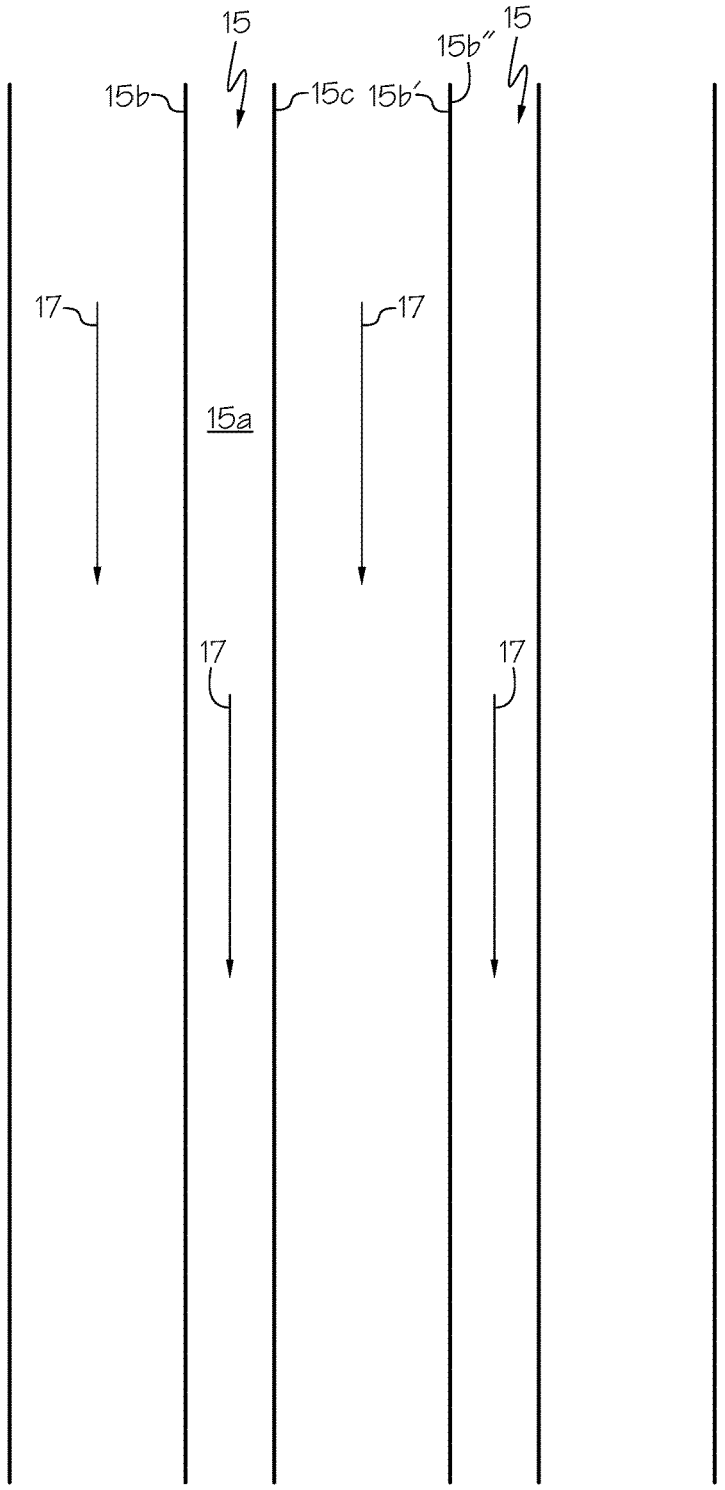
FIG. 2 is a schematic view of an oil passageway of FIG. 1.

FIG. 2 shows that the fin 18, and in particular the fin elements 15, may provide one or more oil paths 17 that can extend along the length of the oil passageway 12. A fin element 15 may provide an oil path 17 between the first and second legs 15*b*, 15*c*. Two adjacent fin elements 15 may provide an oil path 17 therebetween. Thus, for example, a first fin element can provide therein a first oil path, an adjacent second fin element can provide therein a second oil path, and the first and second fin elements can provide therebetween a third oil path.

Also, FIG. 2 shows that one or more legs of the fin element 15, such as the first leg 15*b*, includes two materials with two different coefficients of thermal expansion, such as a 15*b*' and 15*b*". In the depicted embodiment, the material 15*b*' has a coefficient of thermal expansion that is lower than the coefficient of thermal expansion of the material 15*b*".

Referring back to FIG. 1A, the fin 18, and in particular the fin elements 15, may provide one or more moveable windows 16. One or more moveable windows 16 can include a base 16*c*, a first flap 16*a* on one side of the base 16*c*, and a second flap 16*b* on another and opposite side of the base 16*c*. In an embodiment, the flap is a partial cut out from the fin so that the flap has three free sides and one side attached to the base.

The moveable window 16, and in particular one or both of the flaps 16*a*, 16*b*, can move between a closed position and an open position. Typically, when the core 10*a* is in a cold condition, the flap(s) are in the closed position. And when the core 10*a* is in a hot condition, the flap(s) are in the open position. A cold condition is generally defined as less than 60° C. A hot condition is generally defined as greater than 80° C.

The window(s) 16 move as the core 10*a* changes between cold and hot conditions due to the differential in coefficients of thermal expansion of the windows). For example, in a cold condition, the window material having a higher coefficient of thermal expansion may not tend to change shape. The same can apply to the material having the lower coefficient of thermal expansion. In a hot condition, the window material having a higher coefficient of thermal expansion can tend to change shape, while the material having a lower coefficient of thermal expansion does not tend to change shape or has a lesser tendency to change shape.

Figure 3:
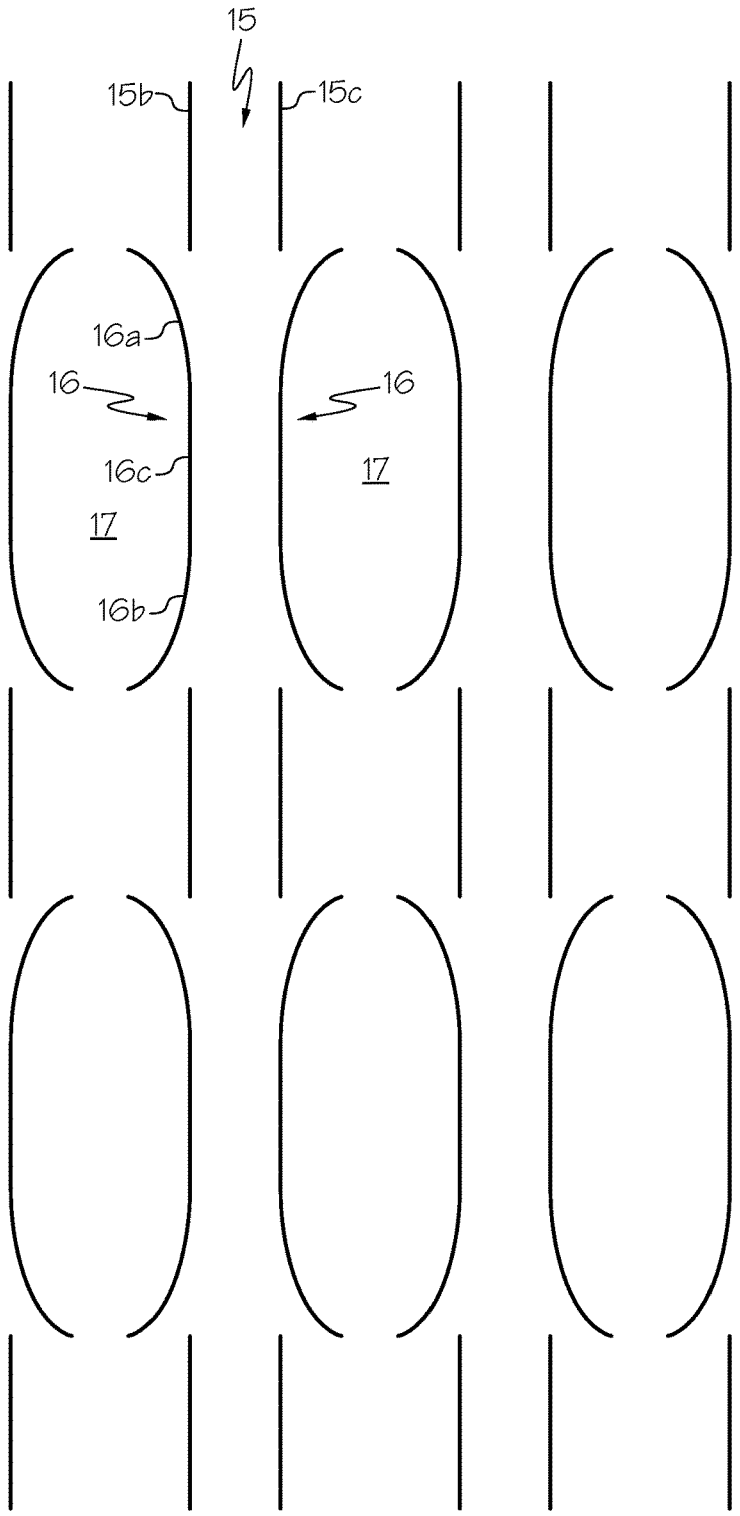
FIG. 3 is a schematic view of an oil passageway, when the core is in a hot condition, of FIG. 1.

FIG. 3 depicts an embodiment of the invention wherein the windows (and their flaps) are arranged in a parallel or symmetrical configuration. In other words, adjacent windows are aligned with one another in at least x and y directions. The fin element 15 has a first leg 15*b* with a window 16, and the fin element 15 has a second leg 15*c* with a window 16. In the hot condition shown, the windows 16 can bend in towards and extend into the oil paths 17. In other words, the flaps 16*a*, 16*b* can extend into, from both sides of, the oil path 17 that is between two adjacent fin elements 15. In a cold condition, the windows can remain or return to the closed position where the windows (and their flaps) are outside the oil path 17 and in plane with its respective leg of the fin element.

Figure 3A:
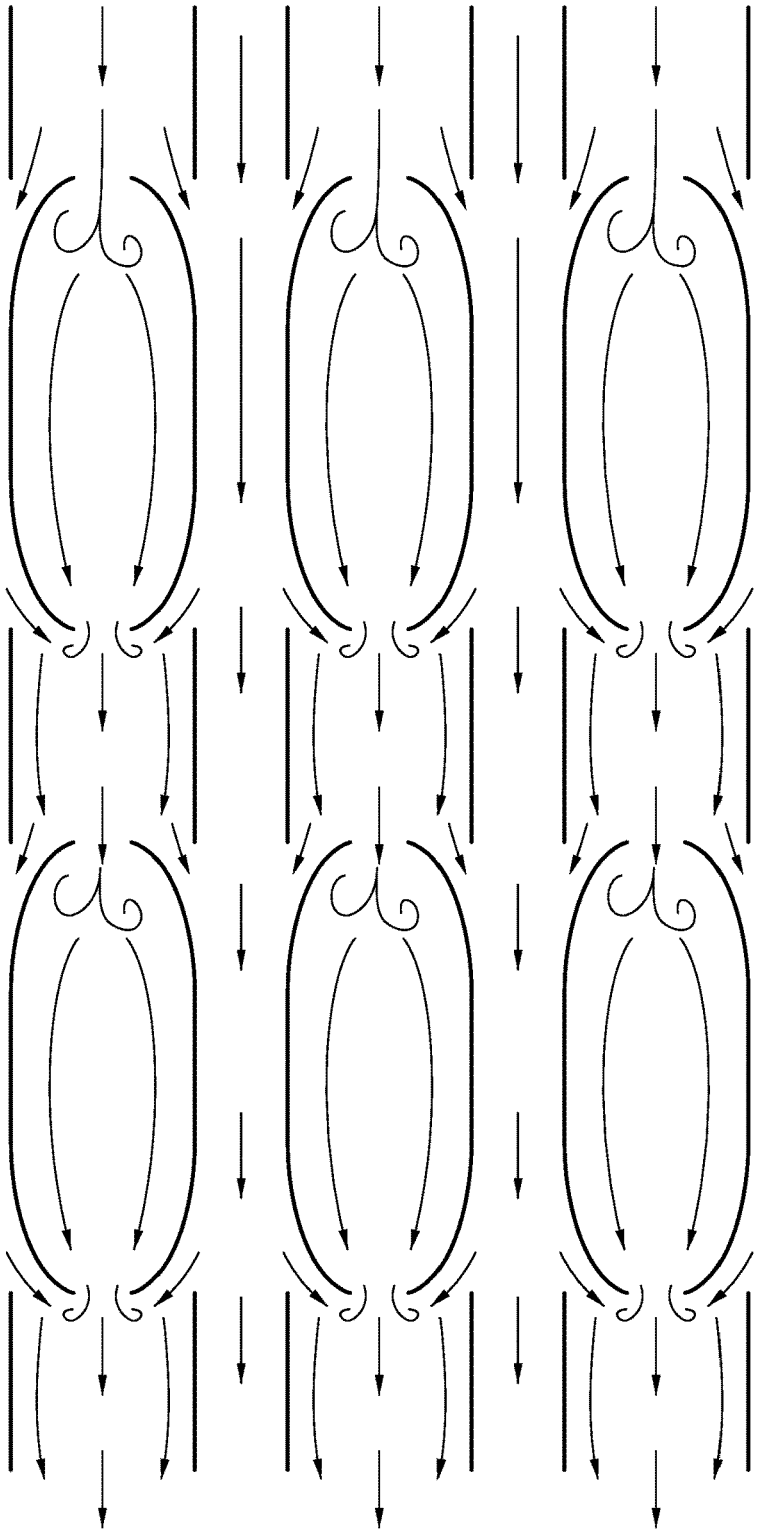
FIG. 3A is a schematic view of oil flow in the oil passageway of FIG. 3.

FIG. 3A depicts an exemplary turbulence in oil flow in the oil paths 17 of FIG. 3. However, the present invention is not intended to be limited by the exemplary depiction in FIG. 3A.

Figure 4:
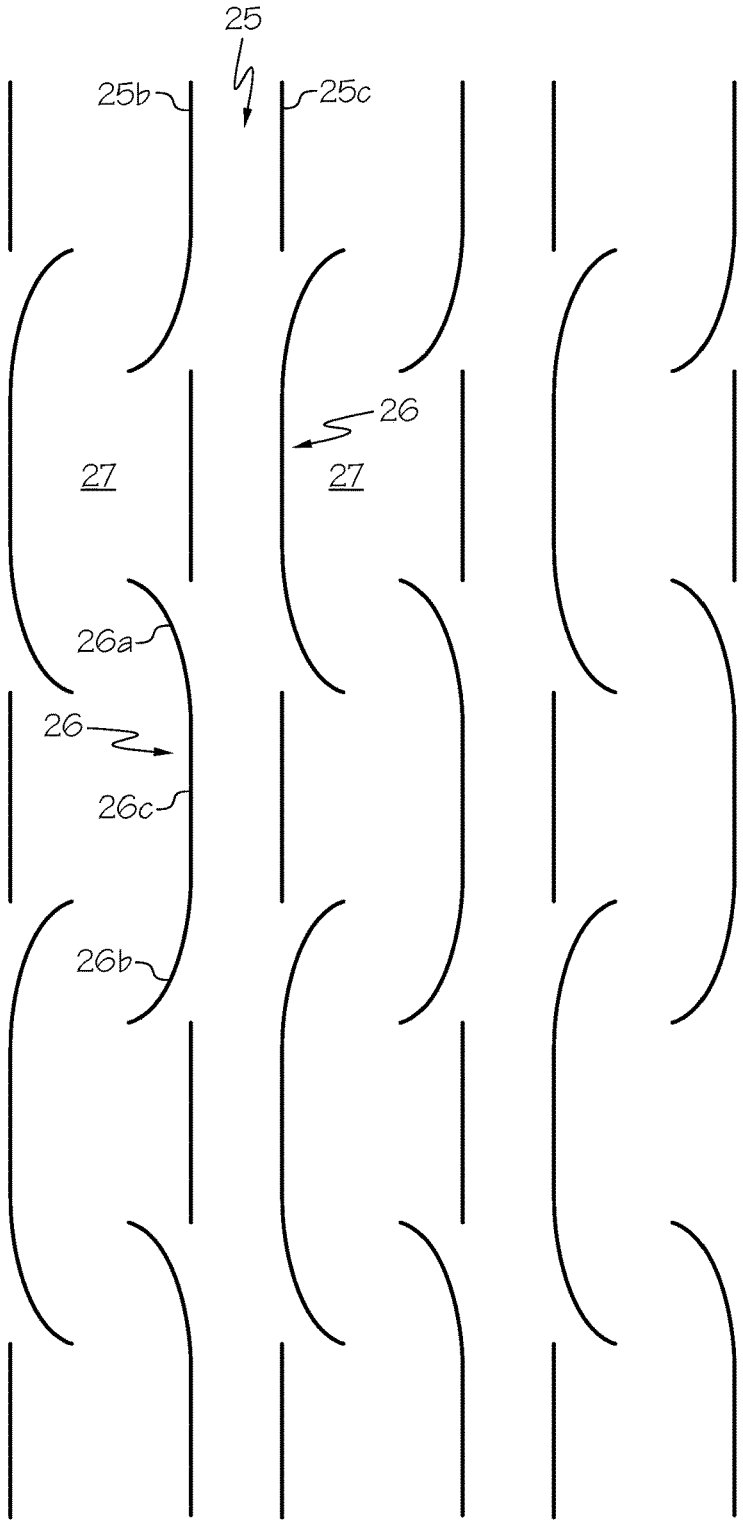
FIG. 4 is a schematic view of another oil passageway, when the core is in a hot condition, of FIG. 1.

FIG. 4 depicts another embodiment of the present invention wherein the windows (and their flaps) are arranged in a staggered, offset, or non-parallel configuration. In other words, adjacent windows are non-aligned with one another in one direction. In the hot condition shown, the fin element 25 has a first leg 25*b* with a window 26, and the fin element 25 has a second leg 25*c* with a window 26. Because of the hot condition, the windows 26 can bend in towards and extend into the oil paths 27. In other words, the flaps 26*a*, 26*b* can extend into, from both sides of, the oil path 27 that is between two adjacent fin elements 25.

Figure 4A:
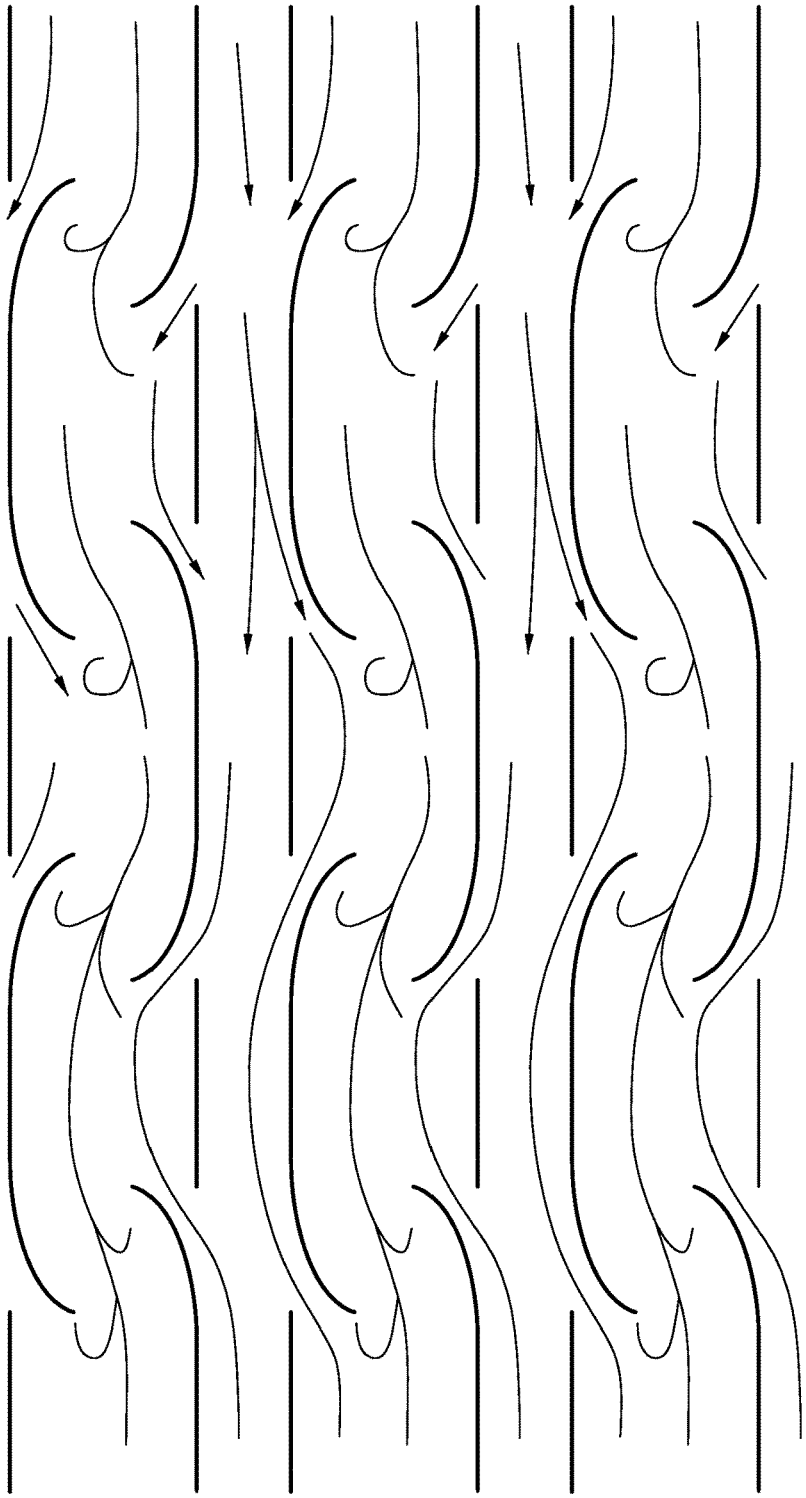
FIG. 4A is a schematic view of oil flow in the oil passageway of FIG. 4.

FIG. 4A depicts an exemplary turbulence in oil flow in the oil paths 27 of FIG. 4. However, the present invention is not intended to be limited by the exemplary depiction in FIG. 4A.

In embodiments, the flaps 16, 26 may be pre-formed when the fin is formed, in a direction such that when the fin is exposed to temperature the window opens rather than closes providing less turbulation and pressure drop. This could be beneficial in improving heat transfer at the exit of the heat exchanger where the power temperature potential does not normally permit as much heat transfer.

In embodiments, distances between the flaps 16, 26 can be the same or different. Similarly, the lengths and/or widths of the flaps 16, 26 can be the same or different.

In embodiments, the fin 18 can be implemented in heat exchangers where a pressure drop is lower when less cooling is required. For example, in charge air coolers, a lower boost, there is less heating from a compressor so less cooling is needed. In a standard charge air cooler, the turbulation need to provide adequate cooling at high boost would just create excess pressure drop at low boost.

The figures illustrating the fin spacing, window flap length, and type are not intended to be limited to the ratios indicated. The fin spacing in the figures show a wide space next to a narrow space. This combination is considered effective, but equal spacing may also be used. The fin spacing may be relatively dense at 20 or more fins/inch or relatively open at 10 or less fins per inch. The amount to which the window flap extends into the flow path is a function of flap length and choice of the two materials for the bimetallic structure. A combination of materials with a greater difference between the low expansion material and the high expansion material will bend more. A longer flap length will extend farther into the passage for the same degree of bending. Judicious use of these features in combination with selection of fin spacing permits good control over the fin turbulation characteristics, providing effective turbulation regardless of spacing.

It should be understood, of course, that the foregoing relates to exemplary embodiments of the invention and that modifications may be made without departing from the spirit and scope of the invention as set forth in the following claims.

I claim:

1. An oil cooler, comprising:

a cooler core having an oil fin;

wherein the oil fin includes a fin element;

wherein the fin element includes a moveable window that provides an opening from one side of the fin element through and to an opposite side of the fin element;

wherein the moveable window includes a window base that divides the opening, a first flap attached on one side of the window base, and a second flap attached on an opposite side of the window base;

wherein the first and second flaps move between a closed position and an open position;

wherein, when the first and second flaps move to the open position, the first and second flaps move towards one another.

2. The cooler of claim 1, wherein the fin is in a serpentine configuration.

3. The cooler of claim 1, wherein the fin element includes an element base, a first leg, and a second leg.

4. The cooler of claim 1, wherein the fin is made of a bi-material.

5. The cooler of claim 1, wherein the fin has a first coefficient of thermal expansion and a second coefficient of thermal expansion.

6. The cooler of claim 5, wherein the first coefficient of thermal expansion is on one side of the fin and the second coefficient of thermal expansion in on another side of the fin.

7. The cooler of claim 1, wherein the fin provides an oil flow path, and wherein the first flap extends into the oil flow path when the first flap is in the open position.

* * * * *